US007451682B2

(12) United States Patent
Quis

(10) Patent No.: US 7,451,682 B2
(45) Date of Patent: Nov. 18, 2008

(54) SEMI-AUTOMATIC SPORTING RIFLE

(76) Inventor: Tomas Quis, Ohrada 1872, Vsetin (CZ) 755 01

( * ) Notice: Subject to any disclaimer, the term of this patent is extended or adjusted under 35 U.S.C. 154(b) by 0 days.

(21) Appl. No.: 11/969,014

(22) Filed: Jan. 3, 2008

(65) Prior Publication Data

US 2008/0134873 A1 Jun. 12, 2008

Related U.S. Application Data

(62) Division of application No. 11/245,118, filed on Oct. 7, 2005, now Pat. No. 7,373,868.

(51) Int. Cl.
*F41C 7/00* (2006.01)
*F41A 19/06* (2006.01)
*F41A 9/61* (2006.01)

(52) U.S. Cl. ..... 89/139; 89/128; 42/69.01; 42/50; 42/18

(58) Field of Classification Search ..... 89/28, 89/139; 42/16, 18, 50, 69.01, 69.02, 69.03
See application file for complete search history.

(56) References Cited

U.S. PATENT DOCUMENTS 2,356,257 A 8/1944 Lowe
4,056,038 A 11/1977 Rath
4,653,210 A 3/1987 Poff, Jr.
5,452,534 A * 9/1995 Lambie ..... 42/18
5,614,691 A 3/1997 Taylor
5,726,377 A 3/1998 Harris et al.
5,806,224 A * 9/1998 Hager ..... 42/18
5,827,992 A 10/1998 Harris et al.
6,070,352 A 6/2000 Daigle
6,293,040 B1 9/2001 Luth
6,442,882 B1 9/2002 Dionne
6,543,169 B2 4/2003 Bero
6,625,916 B1 9/2003 Dionne
6,634,129 B1 10/2003 Freeman, Jr.
7,121,035 B2 10/2006 Greer

* cited by examiner

*Primary Examiner*—Bret Hayes
(74) *Attorney, Agent, or Firm*—Hershkovitz & Associates, LLC; Abe Hershkovitz

(57) ABSTRACT

A semi-automatic sporting rifle is created by the modification of a fully automatic assault rifle Sa vz. 58. The semi-automatic rifle is constructed partly from original parts of the Sa vz. 58 assault rifle, i.e. bolt carrier, locking piece, striker, return mechanism, barrel, trigger, interrupter and left hand side striker catch, partly from modified parts of Sa vz. 58 assault rifle, i.e. bolt, trigger mechanism feather and safety catch and partly from newly manufactured parts, i.e. semi-automatic receiver with a narrowed magazine well for a single stack removable magazine with extended bridge, safety catch with one more groove on its lower left hand side, new sporting stock where grip part and butt-stock part form one unit and barrel extension permanently attached to the muzzle. Some parts of the Sa vz. 58 assault rifle are removed completely, i.e. muzzle thread protector, bayonet lug, original receiver, original stock, pistol grip, release lever, trigger lever and right hand side striker catch. In a second version, an inseparable, double stack magazine box is used.

4 Claims, 15 Drawing Sheets

SEMI-AUTOMATIC SPORTING RIFLE

RELATED APPLICATIONS

This application is a Divisional Application of U.S. application Ser. No. 11/245,118, filed Oct. 7, 2005, now U.S. Pat. No. 7,373,868 B2, entitled "Semi-Automatic Rifle SA vz. 58". The subject matter of this patent application is hereby incorporated by reference herein in its entirety.

BACKGROUND OF THE INVENTION

1. Field of the Invention

The invention relates to firearms, and specifically to rifles similar to military weapons, but modified to be appropriate for civilian, sporting use. This particular invention converts the Czech model Sa vz. 58 to a semi automatic sporting rifle.

2. Discussion of Background Information

An interest exists in collecting and shooting firearms, which have been developed for military purposes and are used by government armed forces. This interest is shared by many civilians. But because most of these weapons have features typical of military weapons, ownership of these guns is strongly restricted and is reserved only to a small number of authorized enthusiasts. On the other hand, weapons without military features are not subject to such restrictions and can be owned, used and transferred among private individuals. A sporting rifle cannot have features typical of a military assault rifle, such as fully-automatic fire, high capacity magazine, military style pistol grip and butt stock, bayonet lug and threaded muzzle.

It is known to convert the Czech model Sa vz. 58 assault rifle into a sporting rifle by the elimination of those parts that ensure the fully automatic function of the gun (i.e. the release lever, right hand side striker catch, right hand interrupter, right hand side of trigger mechanism feather) and inserting a small piece of metal in their place (right hand side of the original receiver). However, this conversion can be reversed by only small changes and adjustments, such that it is possible to install back all the parts that make the features of a military rifle.

SUMMARY OF THE INVENTION

According to the present invention, a military automatic weapon is converted into a semi-automatic sporting weapon that is incapable of easily being re-configured to its original purpose. Specifically, a Czech model Sa vz. 58 fully automatic military rifle is modified to be a semi-automatic weapon only, incapable of reverting to a fully automatic use. The converted rifle is referred to throughout this application as the Sa vz. 58 sporter.

The semi-automatic rifle Sa vz. 58 sporter is made partly from the original parts of an Sa vz. 58 assault rifle, partly from modified parts of an Sa vz. 58 assault rifle, and some new parts, while removing some parts completely. The parts that remain unchanged, include the bolt carrier, the locking piece, the striker, the return mechanism, the barrel, the trigger, the interrupter, and the left hand side striker catch.

According to the invention, the modified parts include the bolt, the trigger mechanism feather, and the safety catch. The bolt is modified by narrowing its sides on its lower end by approximately 0.1 to 2 mm on each side so it would fit, when feeding the cartridges, in between the magazine feed lips of a new narrow single stack magazine. From the original trigger mechanism feather, its right hand arm, in the direction of the fire, is removed, which eliminates its co-operation with the right hand side striker catch and thus consequently with the trigger lever and the release lever. Because the right hand arm has been removed, any attempt to re-install the trigger lever and release lever, is prevented.

According to another aspect of the invention, the safety catch is modified to prevent the rifle from firing in its vertical (downward) position and at the same time allow single shot firing in its horizontal position (forward). This is achieved by making a groove approximately 1 to 9 mm wide and approximately 1 to 5 mm deep in the bottom of the left hand side of the cylindrical part of the safety catch when in its horizontal position (forward), i.e. the position for single shot firing.

According to yet another aspect of the invention, the three-position safety catch of the automatic rifle is eliminated. A rivet is placed approximately 0.5 to 2 mm in the receiver's outside wall above the upper edge of the wing part of the safety catch. This will prevent the backward turning of the safety catch. The safety catch will thus have, after this modification, only two positions, i.e. safe and fire, unlike the three-position safety catch of a fully automatic assault rifle.

According to another aspect of the invention, new parts are made to replace the parts of the automatic rifle. A new semi-automatic receiver is made with an extended bridge and without the original groove for the release lever and, in one embodiment, with a narrowed magazine well for inserting only a single stack magazine. The bridge is extended in a manner that it prevents fully automatic firing, but does not hinder the function of the trigger mechanism during a single shot fire. The semi-automatic receiver has a bridge extended in its length by approximately 1 to 28 mm. Such an extended bridge, without the original groove for the release lever, prevents installation of the release lever. The original release lever is removed along with the right hand side striker catch, and trigger lever.

The semi-automatic receiver has a magazine well narrowed down to approximately 13.3 to 25.5 mm, in order to make it impossible to use high capacity magazines. Because the narrow magazine well of the new receiver is narrower than the original high capacity magazine, a new narrower magazine is made, with the width of its head being approximately between 13.2 mm and 25.4 mm and having a maximum capacity of 10 rounds.

By creating a barrel extension with an inner diameter of approximately 14 mm and an arbitrary length, and by its welding to the muzzle, the possibility of using the threaded muzzle to attach various training extensions, supressors, silencers, grenade launchers etc., which are typical for military assault rifles, is prevented.

Another aspect of the invention lies in a new sporting stock in which the grip part and butt stock part are made in one unit and are not separated from each other.

According to the invention, the following original Sa vz. 58 assault rifle parts are completely removed: muzzle thread protector, bayonet lug, original receiver, original stock, original pistol grip, release lever, trigger lever and right hand side striker catch.

According to yet another aspect of the invention, one version of the semi-automatic Sa vz. 58 sporter rifle is made without a separate magazine, but instead with a double stack magazine box, which is inseparable from the receiver and with which it thus forms one unit. The double stack magazine box is made with an inner width of approximately 20 to 30 mm and height of approximately 70 to 100 mm, in order to have a maximum capacity of only 10 rounds. In this embodiment, the extended bridge remains unchanged and is made in the same way as in the first version. In the case of the second version, the sides of the bolt are not being narrowed.

All three areas of modification, the inclusion of newly manufactured specially designed parts, the modification of some original parts, and the removal of other parts of the original Sa vz. 58 assault rifle will eliminate the main features of this fully automatic assault rifle. The new semi-automatic rifle will enable enthusiasts, to legally acquire such a modified weapon for sporting purposes.

According to a further aspect of the invention, a method of converting an assault rifle to a sporting rifle is provided, wherein the assault rifle includes a bolt carrier and a bolt received therein, the bolt having spaced lower sides, a locking piece, a striker catch, a return mechanism, a barrel, a trigger, an interrupter, and a left hand side and right hand side striker catch. The assault rifle further has a receiver with a bridge including a groove to cooperate with a release lever, a trigger feather mechanism having an arm on each of its sides, a safety catch with at least one groove, wherein the interrupter is biased by a spring bearing against the safety catch, a separate grip and a butt. The conversion occurs by making a receiver with an extended bridge having no groove for a release lever, replacing the assault rifle receiver with the receiver having the extended bridge, replacing the grip and butt by a stock where the grip part and butt part are made in one unit and removing and eliminating the release lever, so that the rifle becomes incapable of automatic firing.

The modifying of the original parts includes removing material from each side of the bolt, removing from the trigger mechanism feather the arm on its right side, as viewed in the direction of fire, whereby the cooperation of the trigger feather mechanism and the right hand striker catch is eliminated, and providing an additional groove on the safety catch at the point where the interrupter spring bears on the safety catch.

According to the invention, there is also provided, as a new part, a rivet in the receiver in a position to contact and prevent the turning of the safety catch rearwardly, thus establishing only a two position safety, making a stock with an integral grip and butt, and removing the assault rifle stock and replacing it with the integral grip and butt stock.

Further, according to the invention, a barrel extension is formed, having an external surface and a smooth internal surface, and welding the extension onto the muzzle of the assault rifle barrel.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
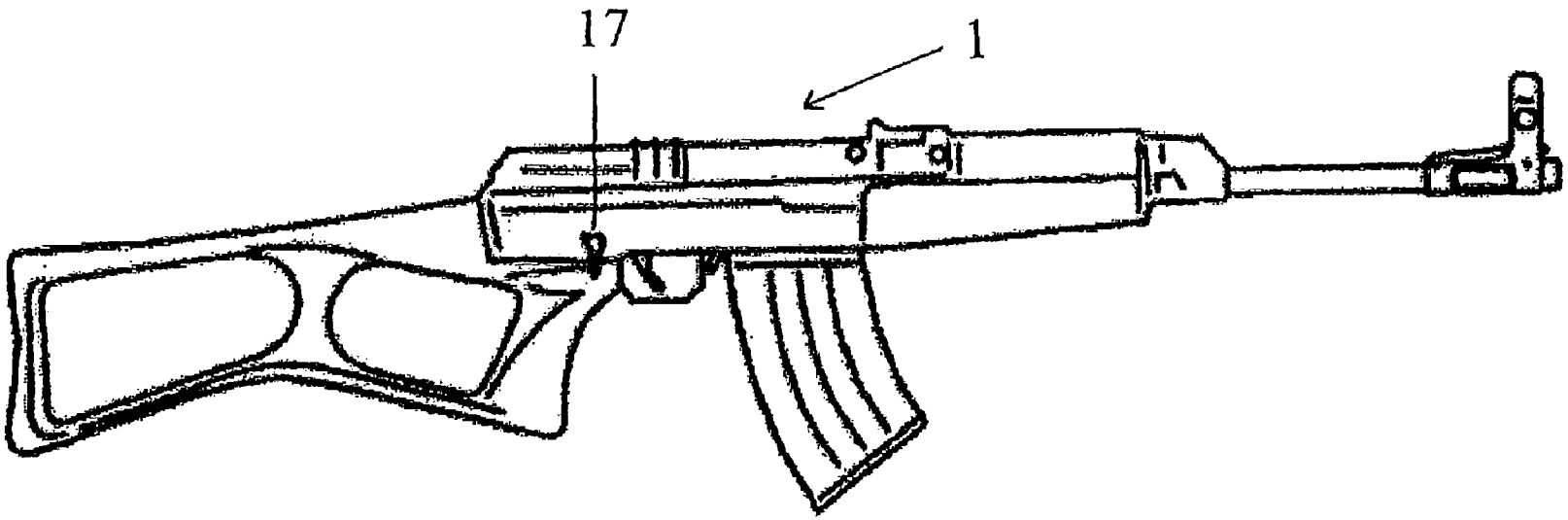
FIG. 1 is an overall side view of the semi-automatic Sa vz. 58 sporter rifle with a single stack magazine.

As can be seen in FIG. 1, the converted semi-automatic sporter rifle 1 retains the original appearance of an Sa vz. 58 model military automatic rifle, but has been created partly from original parts of an Sa vz. 58 assault rifle, partly from modified parts, and partly from newly manufactured parts. Some parts of the Sa vz. 58 assault rifle are removed completely. The specific parts are tabulated below.

The parts, which remain unchanged, include:

the bolt carrier;

the locking piece;

the striker;

the return mechanism;

the barrel;

the trigger;

the interrupter; and the left hand side striker catch.

The following parts are modified:

the bolt;

the trigger mechanism feather; and the safety catch.

Newly manufactured parts include:

the receiver the magazine the barrel extension; and the sporting stock.

Figure 2:
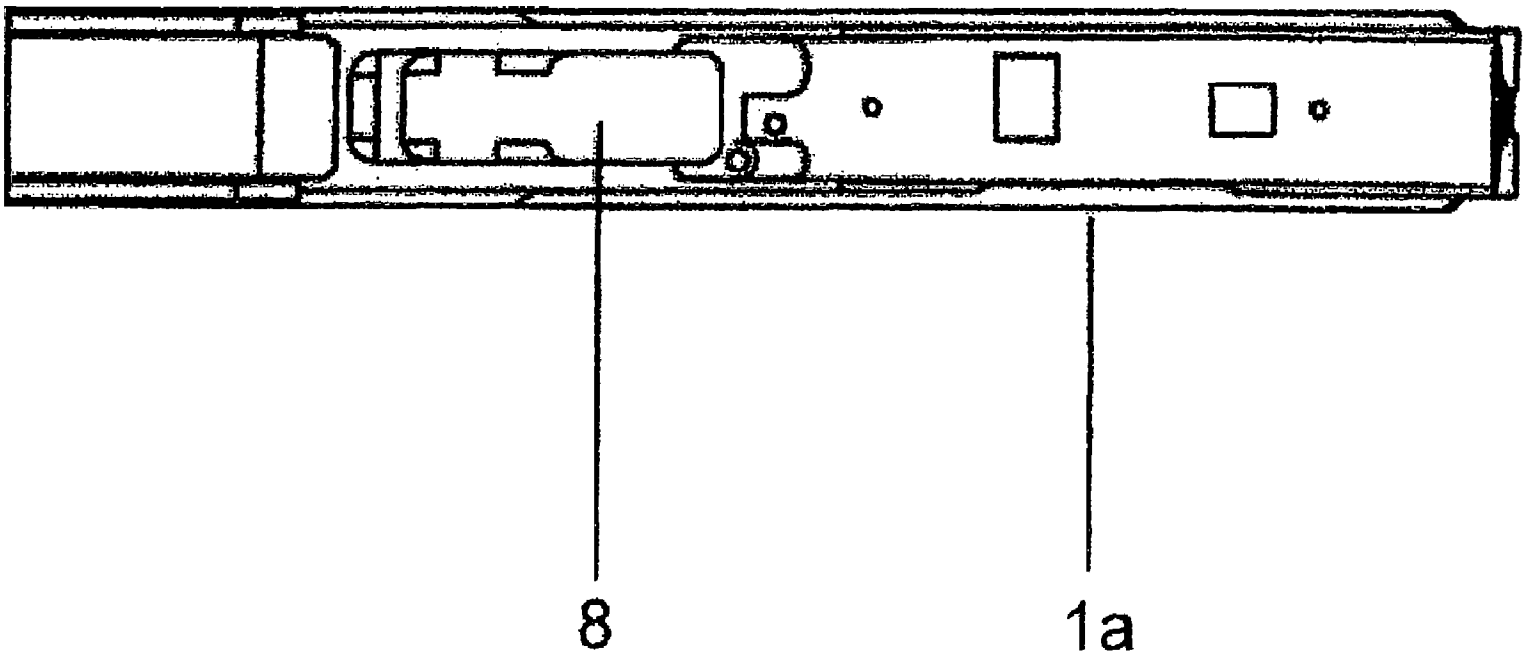
FIG. 2 is a bottom view of a semi-automatic receiver with a magazine well for a single stack detachable magazine.
Figure 3:
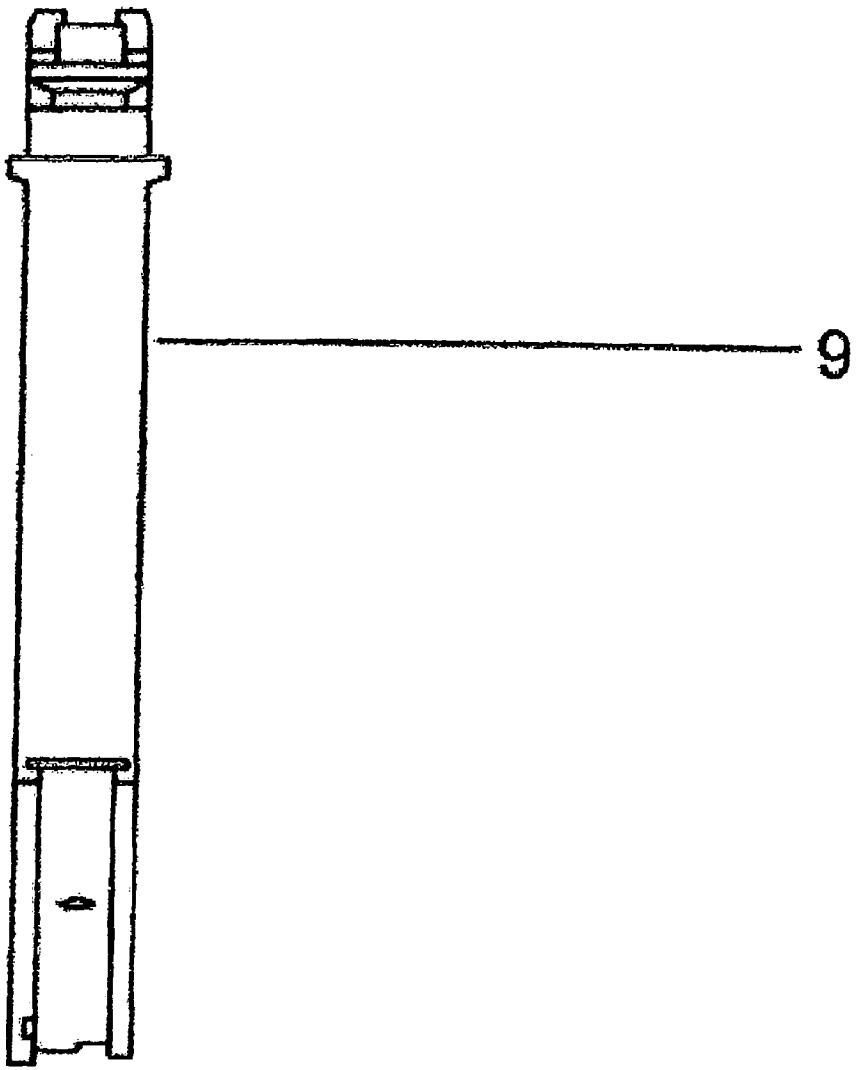
FIG. 3 is a front view of the narrow single stack magazine.
Figure 4:
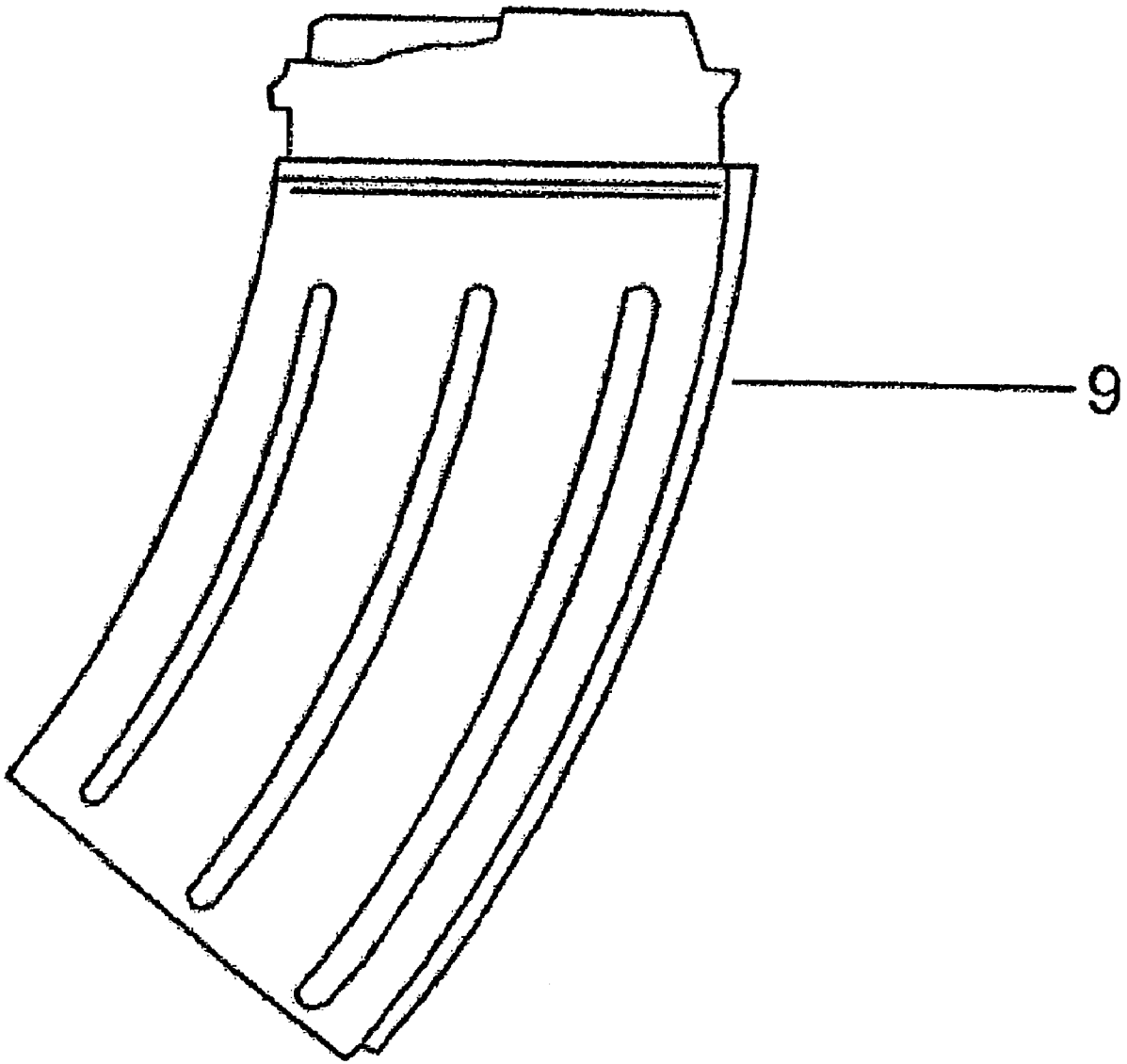
FIG. 4. is a side view of the narrow single stack magazine.

As shown in FIG. 2, the semi-automatic receiver 1*a* has a magazine well 8 for a magazine 9 narrowed to a width of between approximately 13.3 and 25.5 mm. In a preferred embodiment, the width is approximately 19.5 mm. A new, narrow magazine 9 (FIGS. 3 and 4) is created with a maximum capacity of 10 rounds, its head having a width of between approximately 13.2 and 25.4 mm. In a preferred embodiment, a head width of approximately 18.5 mm fits into the narrow magazine well 8 of the new receiver.

Figure 5:
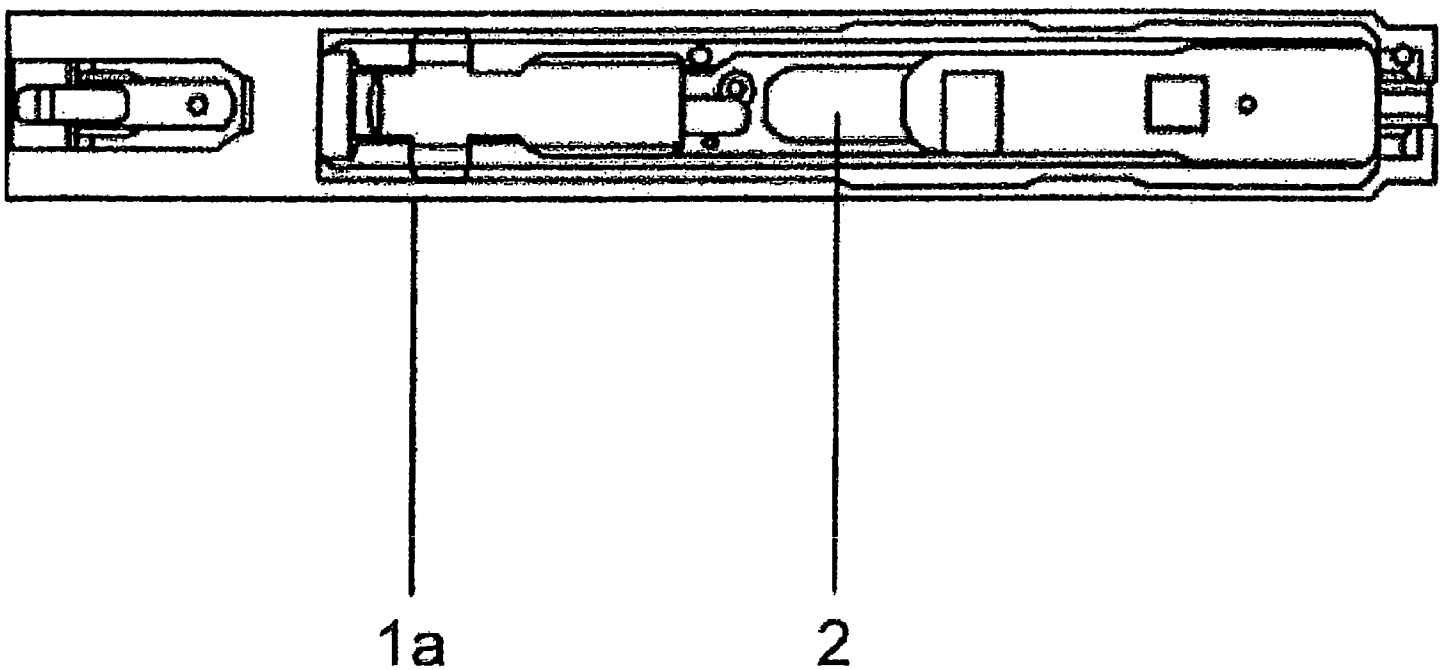
FIG. 5 is a top view of the semi-auto receiver with a magazine well for a single stack detachable magazine.

As can be seen in FIG. 5, the semi-automatic receiver 1*a* includes an extended bridge 2 without a groove for the release lever. Bridge 2 is extended in a way that it prevents fully automatic fire, but enables the functioning of the trigger mechanism for a single shot fire. Bridge 2 has a length extended by approximately 1 to 27 mm, for a total length of approximately between 24 and 50 mm. In a preferred embodiment, the total length is approximately 43.5 mm. An extended bridge 2 of this type, without the original groove for a release lever will prevent installation of the release lever. The original release lever along with the right hand side striker catch, and the trigger lever ensure the fully automatic mode of fire in an original Sa vz. 58 assault rifle.

Figure 6:
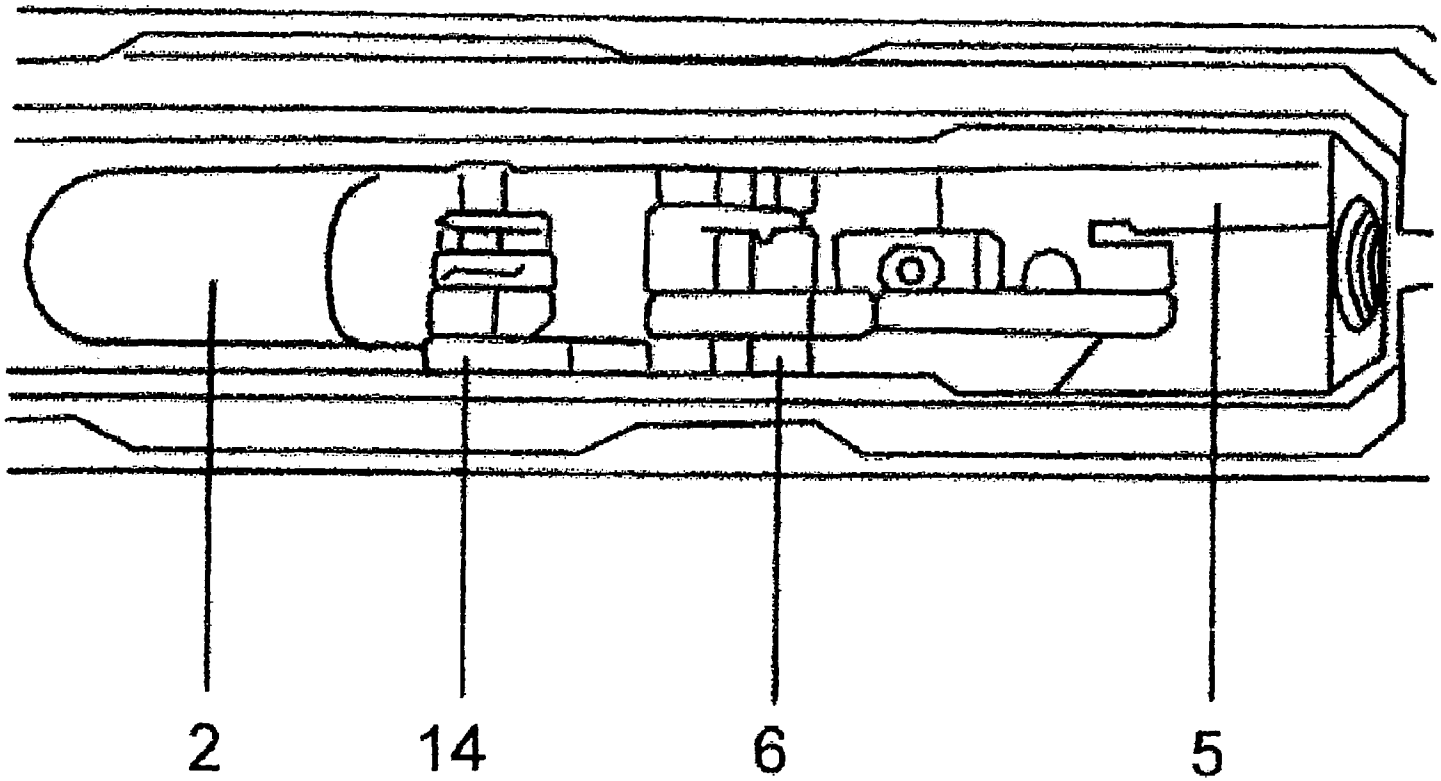
FIG. 6 is a top view of the trigger mechanism.
Figure 7:
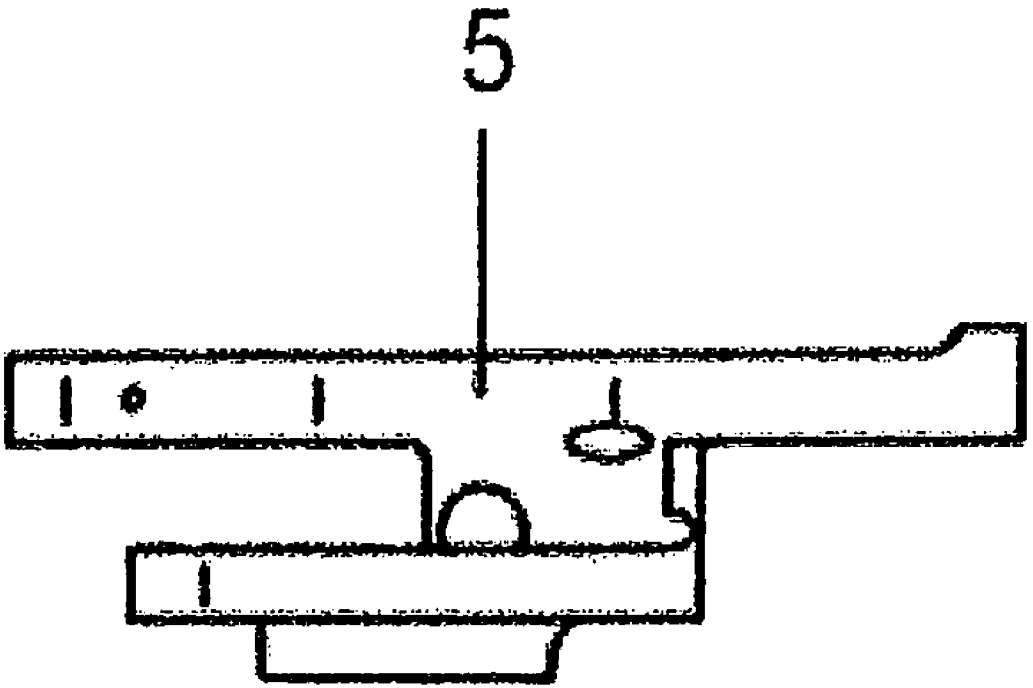
FIG. 7 is a top view of the trigger mechanism feather.

The modified trigger mechanism feather 5, as shown in FIG. 6, has its right hand (in the direction of fire) arm, removed, which eliminates its co-operation with a right hand side striker catch and consequently with a trigger lever and release lever, in an attempt to install these parts back. Only the left hand side (in the direction of fire) arm is kept (see FIG. 7).

Figure 8:
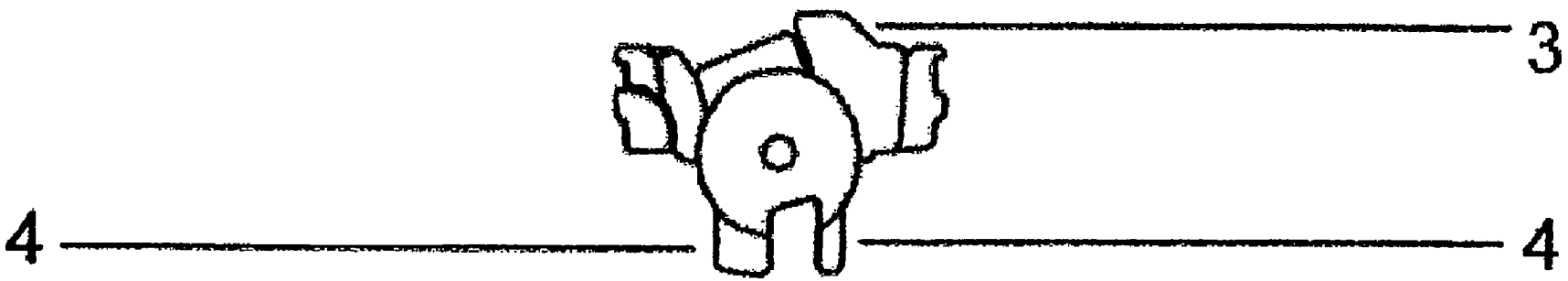
FIG. 8 is a front view of the bolt.

Bolt 3 is modified by narrowing its sides 4 on its lower end by up to approximately 1 mm on each side, to provide a lower bolt width between 6.8 and 10.6 mm (see FIG. 8). The narrowed bolt fits into the magazine feed lips of the new narrow single stack magazine 9 while feeding the cartridges.

Figure 9:
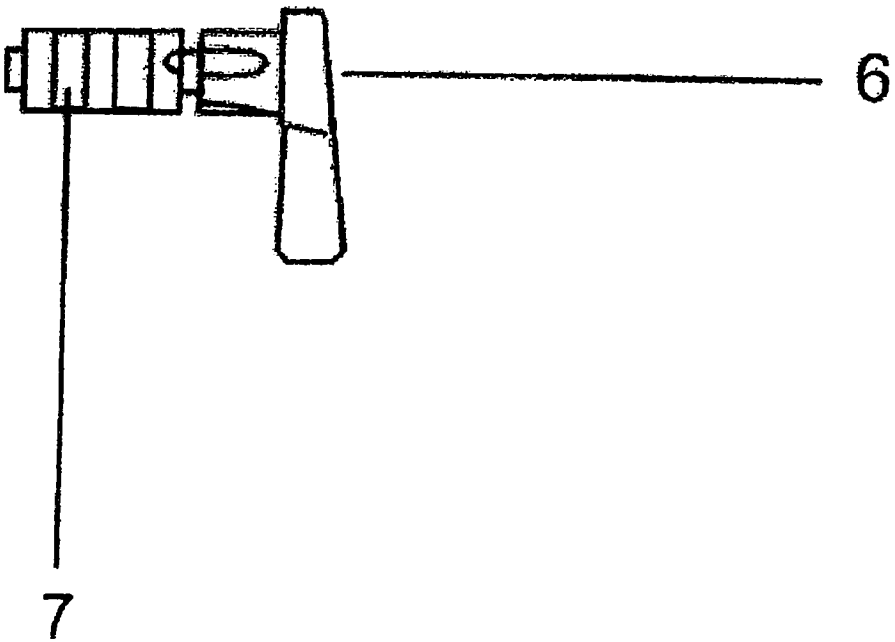
FIG. 9 is a rear view of the safety catch in a safe position.
Figure 10:
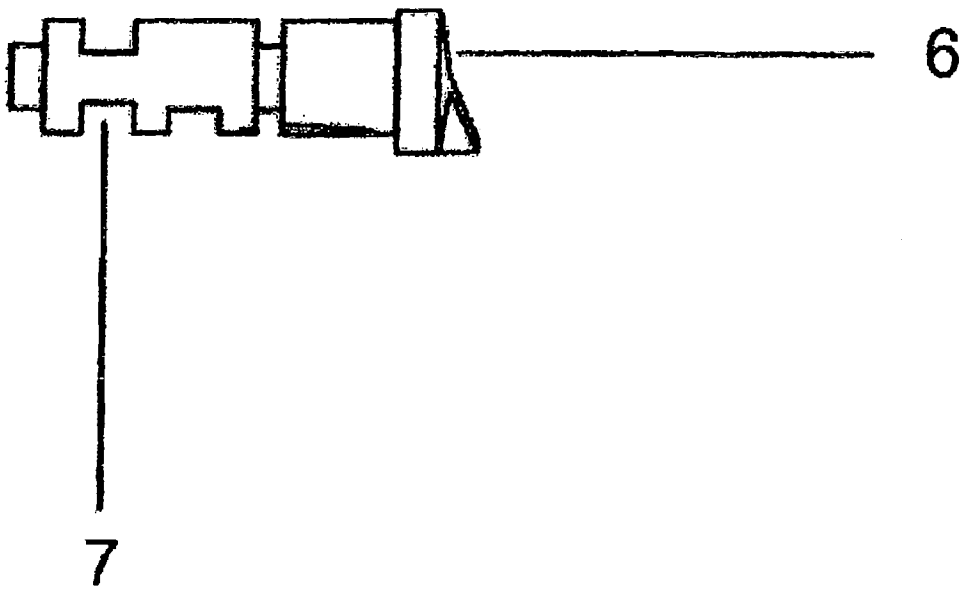
FIG. 10 is a rear view of the safety catch in a firing position.

It is necessary to ensure that safety catch 6, secures the weapon against firing in its vertical position (downward) and at the same time enables single shot firing in its horizontal position (forward). This requirement is achieved by making a groove 7 with a width in the range of approximately 1 to 9 mm, preferably 4 mm, and a depth from approximately 1 to 5 mm, preferably 2 mm, at the bottom of the left hand side of a cylindrical part of the safety catch 6 (see FIGS. 9 and 10). This groove 7 enables, when safety catch 6 points forward, its cylindrical part being turned in such a way, that interrupter 14, which until then, under the pressure of its spring was pushing against a cylindrical part of the safety catch, to fall into the newly made groove. The interrupter moves upwardly and contacts the left hand side striker catch and thus enables its manning and therefore its firing.

Furthermore, about 1 mm above the outside wing part of the safety catch 6, a rivet is placed into the receiver 1*a*, which will thus prevent turning of the safety catch 6 backwardly. Safety catch 6 will thus have, after this modification, only two positions, i.e. safe—fire, as opposed to a three-position safety catch of a fully automatic assault rifle.

Figure 11:
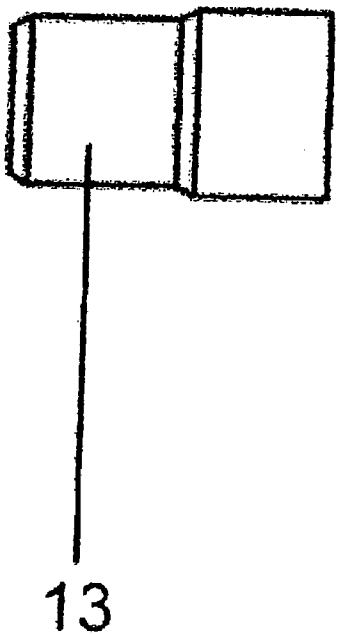
FIG. 11 is a side view of the barrel extension.

A new barrel extension 13, as shown in FIG. 11, is made with an inner thread diameter of approximately 14 mm and a total outside length of approximately 34 mm. When welded onto the muzzle, the barrel extension 13 will prevent the use of the muzzle thread and thus also the possibility of attaching various training extensions, supressors, silencers, grenade launchers, etc., which are typical for military assault weapons.

Figure 12:
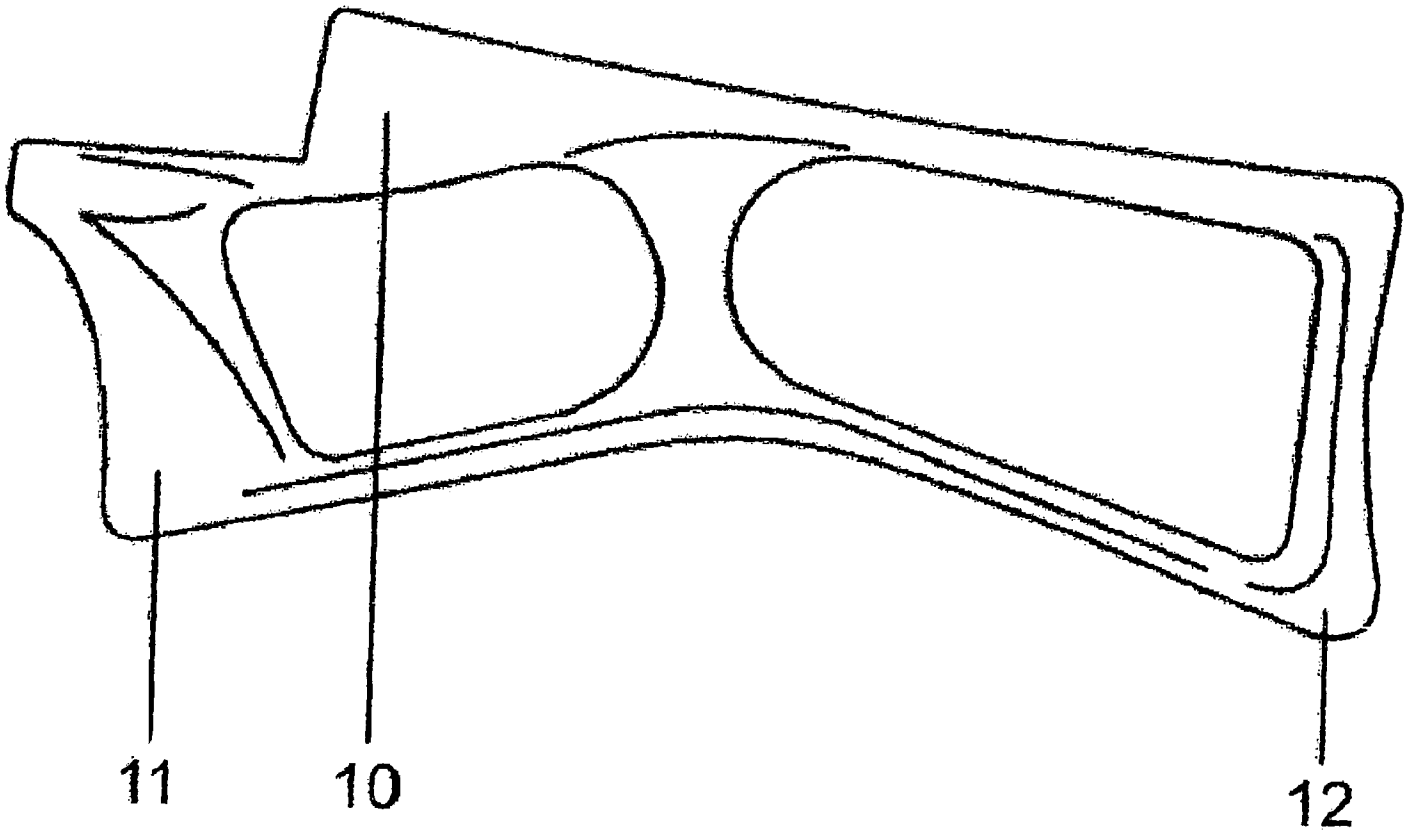
FIG. 12. is a side view of the sporting stock.

The new sporting stock 10 shown in FIG. 12, includes a grip part 11 and butt stock part 12 made as one unit.

The original Sa vz. 58 assault rifles muzzle thread protector, bayonet lug, receiver, stock, pistol grip, release lever, trigger lever and right hand side striker catch are completely removed during the conversion to a sporting rifle.

Figure 13:
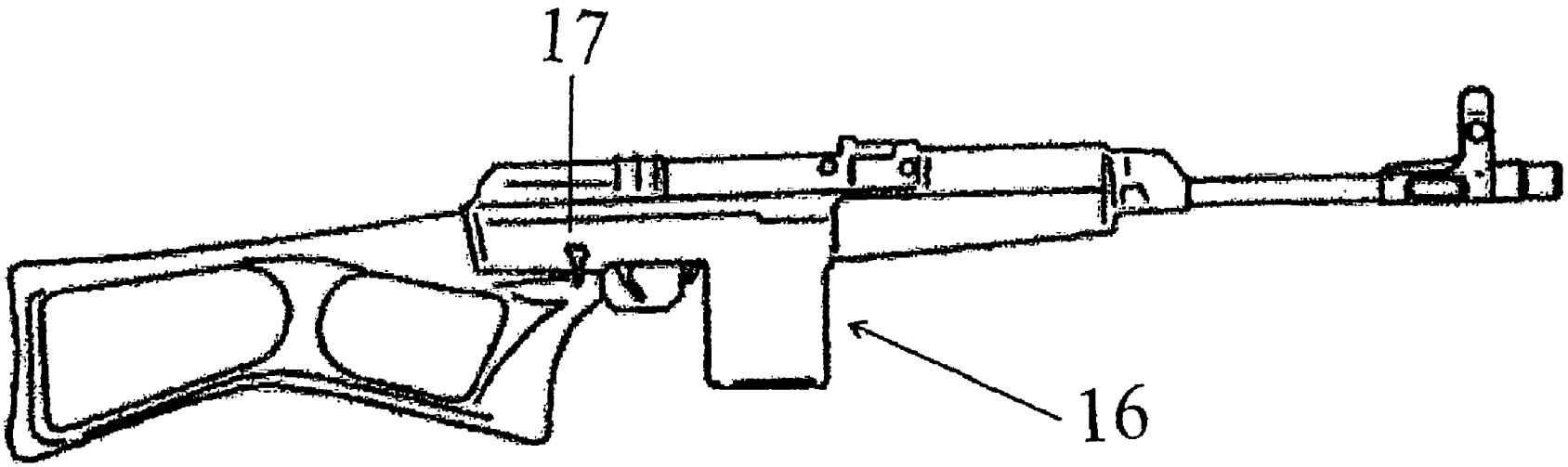
FIG. 13 is an overall side view of the semi-automatic Sa vz. 58 sporter rifle with an inseparable double stack magazine box.
Figure 14:
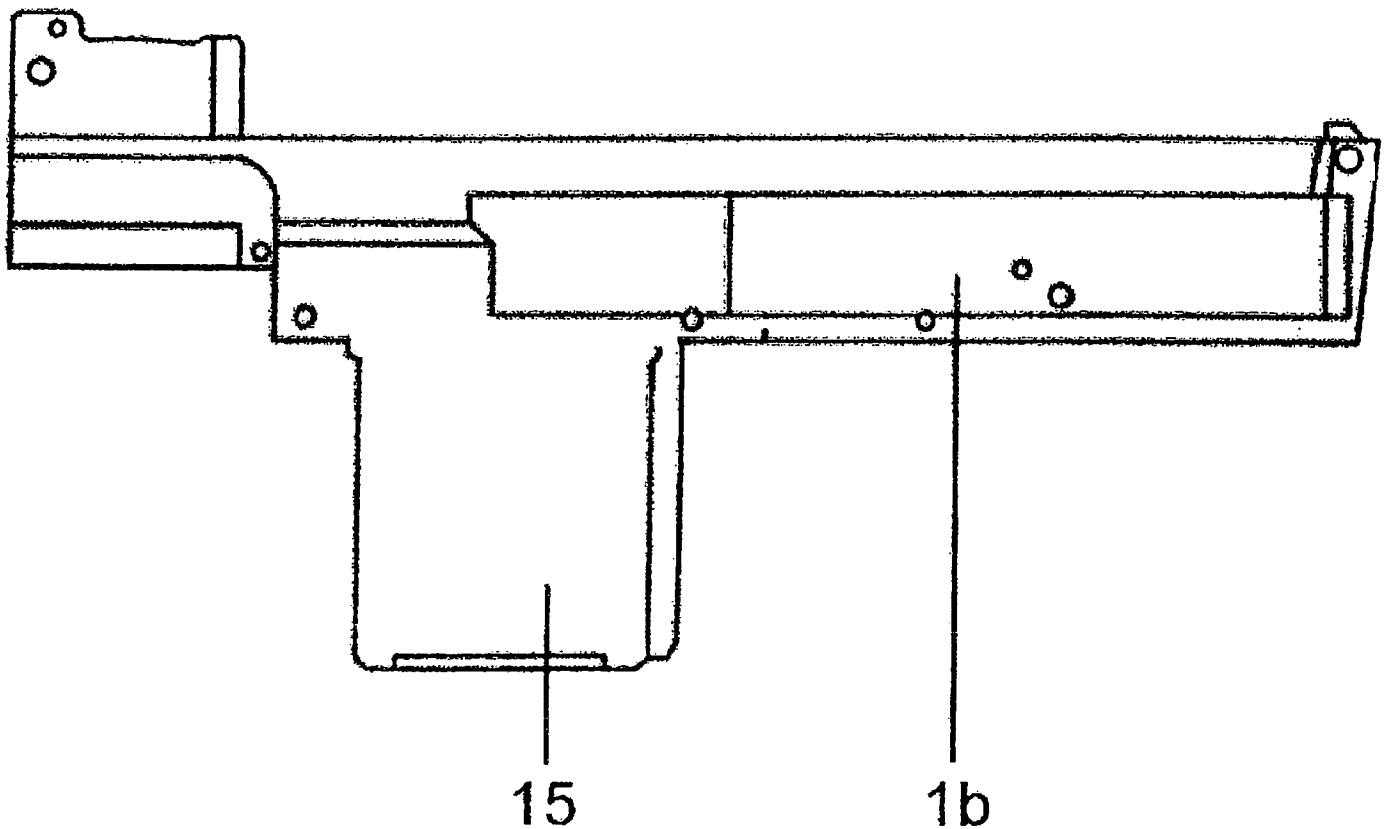
FIG. 14 is a side view of the receiver with an inseparable double stack magazine box.
Figure 15:
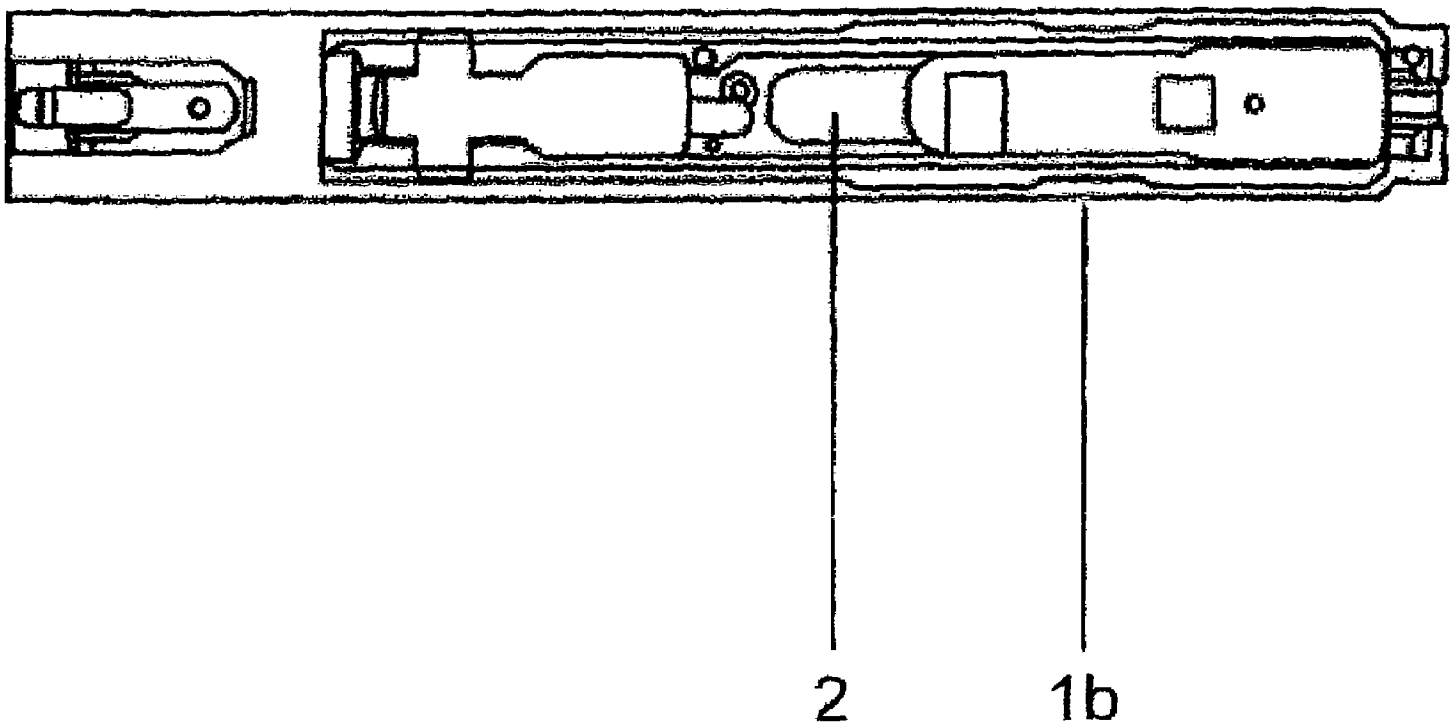
FIG. 15 is a top view of the receiver with an inseparable double stack magazine box.

In another embodiment shown in FIG. 13, the semi-automatic rifle Sa vz. 58 sporter 16 is made without a separate magazine, but with a double stack magazine box 15, inseparable from the receiver 1*b* (see FIG. 14), with which it forms one unit. The double stack magazine box 15 is made with an inner width between approximately 20 and 30 mm, and a height from approximately 70 to 100 mm, in order to have a maximum capacity of 10 rounds. In a preferred embodiment, the inner width is approximately 25 mm and the height is approximately 85 mm. Extended bridge 2 remains unchanged and is made the same way as in the first version of the semi-automatic Sa vz. 58 sporter rifle. However, unlike the first version, in the double stack magazine version, the sides 4 of the bolt 3 are not narrowed because the original bolt fits, when feeding the cartridges, in between wide feed lips of the double stack magazine box without modification. Magazine box 15 has to be a double stack in order to allow filling with cartridges from the top, because any other filling is not technically possible due to the inseparability of the magazine box from the receiver.

The semi-automatic rifle Sa vz. 58 sporter conversion will allow a wide range of civilian users to own a rifle, very similar to the fully automatic assault rifle Sa vz. 58 that can only be used by armed forces members.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS USED IN THE DRAWINGS

1—The converted single stack magazine rifle;
1*a*—semi-automatic receiver;
1*b*—semi-automatic receiver with inseparable double stack magazine box;
2—bridge;
3—bolt;
4—bolt sides;
5—trigger mechanism feather;
6—safety catch;
7—new groove on the safety catch;
8—magazine well of the receiver;
9—single stack magazine;
10—sporting stock;
11—grip part of the sporting stock;
12—butt-stock part of the sporting stock;
13—barrel extension;
14—interrupter;
15—inseparable double stack magazine box; and
16—converted double stack magazine rifle;

What is claimed:

1. A semi-automatic rifle, created from an automatic assault rifle, the assault rifle having a receiver with a bridge, a magazine well to receive a magazine, a bolt, a trigger feather mechanism having at least one arm, a safety catch with at least one groove, and a stock including grip and butt parts, the semi-automatic rifle comprising:

a semi-automatic receiver with a semi-automatic receiver bridge and an inseparable magazine box;

a modified trigger mechanism feather with only one arm;

a safety catch with at least first and second grooves;

a one piece sporting stock having an integral grip and butt; and a barrel extension.

2. A semi-automatic rifle according to claim 1, wherein said magazine box has an inner width between approximately 20 and 30 mm and a height between approximately 70 and 100 mm.

3. A semi-automatic rifle according to claim 2 wherein said magazine box has an inner width of approximately 25 mm and a height of approximately 85 mm.

4. A semi-automatic rifle according to claim 1, wherein the automatic rifle is a Sa vz. 58 model assault rifle.

* * * * *